United States Patent [19]

Recupero

[11] 4,006,927

[45] Feb. 8, 1977

[54] DOOR HANDLE ATTACHMENT

[76] Inventor: Thomas A. Recupero, 31 Marron Ave., Stoughton, Mass. 02072

[22] Filed: Dec. 10, 1975

[21] Appl. No.: 639,462

[52] U.S. Cl. ..... 292/336.3

[51] Int. Cl.[2] ..... E05C 13/00

[58] Field of Search ..... 292/336.3, 221, 166, 292/173

[56] References Cited

UNITED STATES PATENTS

| | | | |
|---|---|---|---|
| 2,304,145 | 12/1942 | Borchers | 292/336.3 |
| 3,144,268 | 8/1964 | Rowe | 292/336.3 |

*Primary Examiner*—Richard E. Moore
*Attorney, Agent, or Firm*—James H. Grover

[57] ABSTRACT

An attachment for a door latch housing which has a hand grip and a latch button, includes a bracket pivotally mounting a first order hand lever with an elongate handle, and clamping members on the bracket adapted to be secured to the hand grip of the door with the handle of the lever extending below the hand grip of the door and the other end of the lever opposing the latch button. When the lever handle is pulled away from the door the opposite end of the lever actuates the button releasing the latch, the lever handle then pulling open the door.

4 Claims, 2 Drawing Figures

DOOR HANDLE ATTACHMENT

BACKGROUND OF THE INVENTION

Screen doors and combination screen and storm doors are commonly installed outside the inside doors of homes. This invention relates to an attachment to the outside door latch housing. Typically the latch housing is a molded aluminum fixture including a hand grip for fingers and above the grip a latch actuator operated by the thumb. The latch actuator may be a push button or a short lever pressed toward the door by the thumb. As well described in U.S. Pat. No. 3,317,231 to M. W. Lindquist, such latches are too high and difficult for children to operate. Such doors are also difficult for burdened housewives to open because they require the use of the fingers and thumb. Accordingly the object of the present invention is to provide an improved attachment to an external door which facilitates opening of the door.

STATEMENT OF INVENTION

According to the invention an attachment for a door latch housing having a hand grip and an extended latch actuator comprises a bracket, a lever pivotally mounted on the bracket, and means on the bracket for clamping the bracket to the hand grip with one end of the lever opposed to the plunger and the other end extending below the hand grip so that pulling on the other end engages said one end with the actuator so as to unlatch and open the door.

DRAWINGS

Figure 1:
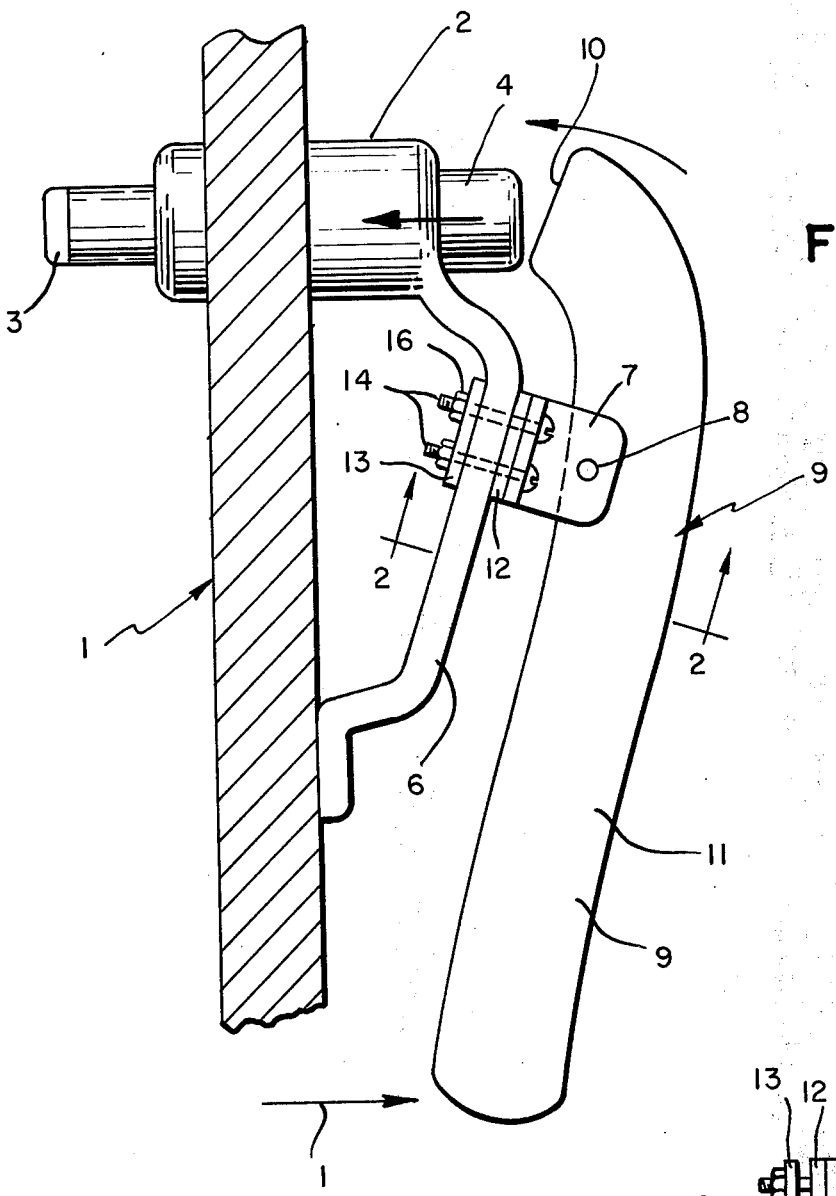
Figure 2:
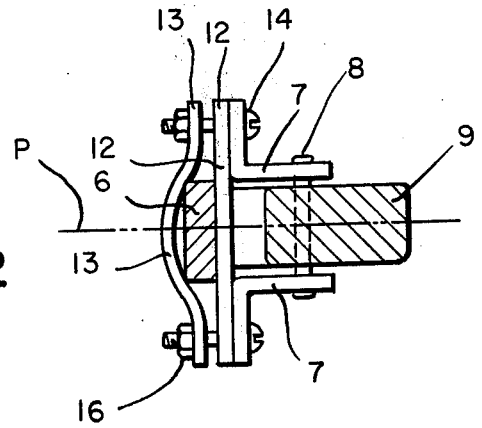

FIG. 1 is a side elevation of the attachment to a door shown fragmentarily in section; and FIG. 2 is a section on line 2—2 of FIG. 1.

DESCRIPTION

As shown in FIG. 1 a typical screen or combination door comprises a metal frame 1 to which is secured a latch housing 2. The door 1 swings in the direction 1* about a pivot beyond the plane of the drawing. The latch housing 2, usually of molded aluminum, includes an inside latch lever 3, not involved in the present invention and an external latch actuator 4. The external actuator may be a push button, as shown, or a short lever moved in the same direction as the button. Extending downwardly from the external portion of the latch housing is an integral hand grip 6. The latch housing 2, internal and external latch actuators 3 and 4, and the hand grip 6 are permanently affixed to the door 1.

The attachment of the present invention comprises a bifurcated bracket 7 with a pivot pin 8 for a first order lever 9. The lever 9 has at its upper end a nose 10 opposed to the latch actuator 4 and an elongate handle 11 extending downwardly from the pivot pin 8 substantially below the permanent hand grip 6 of the latch housing 2. Combined with the bracket 7 are two clamp members 12 and 13. Four bolts 14 pass through the bracket 7, clamp members 12 and 13 and are secured by nuts 16 which are tightened to clamp the two members 12 and 13 on the permanent hand grip 6 of the latch housing 2.

No modification of the existing door by drilling or other entry is needed to secure the clamp members 12 and 13 of the attachment 9 to the door frictionally. Moreover, because the hand grip 6 and push button 4 are permanently aligned in a plane perpendicular to the door 1 (parallel to the plane of FIG. 1) clamping the attachment of the present invention to the door hand grip 6 will align the lever 11 so that it is located and pivots in the plane common to the hand grip. As shown in FIG. 2, the door hand grip 6 has generally flat surfaces which may be gripped by one or more flat surfaces on the clamping members to insure alignment of the attachment in the common plane P of the door hand grip 6 and latch button or other latch actuator. Consequently the upper end of the lever 9 is not only accurately opposed to the push button 4, but also its pivoted motion is in the same common plane as is the plunging motion of the push button. Additionally the pivotal motion of the lower end of the lever is in the same direction 1* as the opening movement of the unlatched door. Thus the movement of the user's hand is in a direction most effective for unlatching and opening the door, whereas with the device of the aforementioned U.S. Pat. No. 3,317,231 the user's hand must twist the handle and exert force laterally of the door in a direction not wholly aiding opening of the door. With the present invention a burdened housewife may open the door without twisting or otherwise using her hand by inserting her elbow in the space between the door and the handle 11 and pushing the handle outwardly.

The present invention thus has the advantage of being uncomplicated and inexpensive to manufacture. It is attachable to a door without drilling mounting holes, and is self-aligning in a plane through which force is most effective in unlatching and pulling the door open with or without use of the hand.

It should be understood that the present disclosure is for the purpose of illustration only and that this invention includes all modifications and equivalents which fall within the scope of the appended claims.

I claim:

1. An attachment for a door latch housing having a hand grip and an external latch actuator comprising a bracket, a lever pivotally mounted on the bracket, and means on the bracket for clamping the bracket to the hand grip with one end of the lever opposed to the plunger and the other end extending below the hand grip so that pulling on the other end engages said one end with the actuator so as to unlatch and open the door, wherein the lever pivots in a plane common to the door handle and latch actuator.

2. An attachment according to claim 1 wherein the clamping means aligns the lever in said common plane.

3. An attachment according to claim 1 wherein the clamping means frictionally grips the door hand grip without entering the door.

4. An attachment for a door latch housing having a hand grip and an external latch actuator moving in a plane common with the hand grip, the attachment comprising:

a bifurcated bracket having a pivot extending between the bifurcations, a first order lever mounted on the pivot between the bifurcations, the lever having a relatively short upper end and a relatively long lower end, and means on the bracket for frictionally clamping the bracket to the door hand grip without entering the door, the clamping means being shaped to align the lever with its upper end opposed to the latch actuator and its lower end extending substantially below the door hand grip for pivotting in said common plane so that pulling or elbowing the lower lever end engages the upper end with the actuator so as to unlatch and open the door.

* * * * *